US005085600A

United States Patent [19]

Damron

[11] Patent Number: 5,085,600

[45] Date of Patent: Feb. 4, 1992

[54] AUTOMOTIVE BLADE-TO-FERRULE FUSE ADAPTER

[76] Inventor: Matthew S. Damron, 26535 Van Born Rd., Taylor, Mich. 48180

[21] Appl. No.: 663,269

[22] Filed: Mar. 1, 1991

[51] Int. Cl.[5] ..... H01R 13/66

[52] U.S. Cl. ..... 439/621; 439/682

[58] Field of Search ..... 439/621, 622, 660, 682, 439/698, 699

[56] References Cited

U.S. PATENT DOCUMENTS

| | | | |
|---|---|---|---|
| 3,717,836 | 2/1973 | Humphrieys | 337/271 |
| 3,813,626 | 5/1974 | Cetola et al. | 337/245 |
| 3,976,967 | 8/1976 | Magherini | 337/211 |

OTHER PUBLICATIONS

Bussman Manufacturing Co., Ferrule-to-Blade Fuse Adapter Model No. A-77 (hand-sketch of).

*Primary Examiner*—Gary F. Paumen
*Attorney, Agent, or Firm*—Harness, Dickey & Pierce

[57] ABSTRACT

A low voltage fuse adapter for allowing a blade-type automotive fuse to be used in a socket for glass ferrule fuse of the type widely used in automotive vehicles. One version of the fuse adapter has a supportive insulating body with at least two end faces and at least two slots between the end faces, two contact members made of electrical conductive materials formed in a preselected shape and disposed within each slot, and two caps with each cap being fixed at the end of the supporting body and each cap being in electrical contact with one contact members. A second shorter version of the fuse adapter has a similar structure, except that the insulating body is shorter, and the caps have slotted openings to permit the blades of the blade-type automotive fuse to pass through to the slotted openings to the contact members located thereunder. Both versions of the automotive blade-to-ferrule fuse adapter may be provided as part of fuse socket conversion kit. The fuse kit includes a blade-type fuse in combination with one of the aforementioned fuse adapters.

20 Claims, 3 Drawing Sheets

AUTOMOTIVE BLADE-TO-FERRULE FUSE ADAPTER

TECHNICAL FIELD

This invention relates in general to low voltage fuses and fuse socket arrangements used in automobile electrical systems, and in particular to low voltage fuse adapters which permit a standard automotive blade-type fuse to be used in a socket for a standard automotive glass ferrule-type fuse.

BACKGROUND

In automotive vehicles today, there are two main types of low voltage (i.e., 6 to 24 volt) fuses in use. The first and older type of low voltage automotive fuse is the glass ferrule fuse, which is also called a cartridge-type fuse, and has a hollow glass body. Like almost all fuses, it contains a small filament or fuse link that is designed to melt and interrupt the circuit if too much current passes through the fuse. The second and newer type of low voltage automotive fuse called an automotive blade-type fuse, which also includes a fuse link and which is further described below. FIG. 1 of the drawings shows an exemplary fuse box which contains both types of fuses, as well as two preferred sizes of the fuse adapter of the present invention.

The ferrule fuse is designed to fit within a ferrule fuse socket. Each automotive vehicle has at least one fuse box and each has numerous fuses and sockets as illustrated in FIG. 1. The ferrule fuse socket, in particular, is usually a rectangular recess which most often comes in two relatively standard sizes, the first or large size being approximately 1⅜ inch (in.) by ⅜ in., and the second or smaller size being approximately ⅞ in. by ⅜ in. by 154 in. Each standard size socket is typically provided with a pair of spring-steel retaining clips designed to removably accept and make electrical contact with the metallic end caps of a standard size glass-type ferrule fuse.

The Society of Automotive Engineers ("SAE") Standard No. J554b lists the following five sizes as standard lengths for the glass ferrule (i.e., cartridge type) fuse: 1.25 inch, 1.062 inch, 0.875 inch, 0.75 inch, and 0.625 inch. Each of these sizes has the same basic diameter, which is in a range from 0.247 to 0.253 inch, i.e., about one-quarter inch. In practice, I have observed that the two most commonly used length fuses appear to be the 1.062 inch length fuse and the 0.75 inch length fuse. An estimated one-half of the 100 million cars and trucks on the road today in this country utilize glass ferrule fuses to protect their electrical systems.

Generally speaking, anyone who has attempted to change a glass ferrule fuse has had a difficult experience. These fuses are difficult to access for several reasons. The fuse box itself may be in a location difficult to reach, especially in older cars. In most fuse boxes, the fuses are recessed and difficult to grasp using just the hand. Glass is fragile by nature, and a glass ferrule fuses tends to break when incorrectly pried from its socket. A common solution to the problem is the use of a special tool which can clamp onto the body of the fuse. Insertion and extraction is obviously facilitated by use of this special tool. However, many car owners do not own this tool, or if they do, they do not carry it in their vehicles, which makes it unavailable if they should need it while on the road. Other common problems include complaints that the ferrule fuses are not well labeled and that their labels are difficult to read. I have found that some automotive parts stores are discontinuing or are in short supply of the glass ferrule fuses, even in the commonly used amp ratings. So, as a practical matter, the cars that use the older type fuses may outlast the production or at least the ready supply of the ferrule automotive fuse.

The above problems have necessitated the design of the newer blade-type fuse, which is described in SAE Standard J1284. The automotive blade-type fuse is universal, in that it comes in one standard physical size for the various amp ratings. The amp rating is printed in bold, easy-to-read letters on the plastic body of the fuse. The blade-type fuse is generally rectangular in shape, having a plastic body and two metal flat prongs or blades protruding from the body and providing the electrical pathway to the fuse filament located with the body of the fuse. The blades are coplanar. Each blade generally extends outwardly from the fuse body by about ¼ inch, is about 3/16 in. wide, and slightly less than 1/32 in. thick. The standard blade-type fuse has 3/16 in. space between the two prongs. An illustrative blade-type fuse is illustrated in the bottom left-hand corner of FIG. 1. Most modern cars have fuse boxes designed to accept these standard blade fuses. The advantages of these newer fuses are that they are easier to replace, are more readily available, and are generally less expensive.

Until the present invention, persons driving older model cars were susceptible to the short supply and rising price of the older glass-type fuse. Accordingly, it is the object of the present invention to provide a fuse adapter that will allow the use of a newer blade-type fuse in an older ferrule fuse socket. It is a further object of this invention to provide an inexpensive and easy means to upgrade the fuse type used in the electrical systems in older model cars.

It is a further object of this invention to provide blade-to-ferrule fuse adapters for use with both the long and short ferrule fuse sockets. It is a further object of this invention to provide owners of older model cars with devices so that they can protect their electrical system using blade-type fuses without the necessity of replacing the entire fuse box assembly.

SUMMARY OF THE INVENTION

In light of the foregoing problems and to fulfill the above-stated objects, there is provided, according to one aspect of the present invention, a fuse adapter that will permit automotive blade-type fuses to be used in an automotive fuse box sockets or like clips designed to receive standard glass ferrule fuses. In general, the fuse adapter has an elongated, rigid body which has at least two end portions electrically insulated from one another. Each of the end portions are provided with an elongated slot therein. The fuse adapter also includes two blade contact means made of electrically conductive material, each being for receiving and making electrical contact with one of the two blades of a blade-type automotive fuse. Each of these blade contact means may be constructed as a separate metal part or member formed to a preselected shape which is designed to be disposed within one of the slots in the body. Finally, each adapter also includes two end cap means for making electrical contact with an electrically conductive retaining clip used within a standard size socket for an automotive glass ferrule fuse. Each end cap means may be constructed as separate part of thin sheet metal stock having a generally cylindrical configuration. Each cap is preferably fixed at an end portion of the body, and each cap is in electrical contact with one of the blade contact means or members. The slots and contact members are generally elongated and longitudinally arranged with respect to the insulating body and coplanar with respect to each other. In this manner, the fuse adapter of the present invention is thus configured to removably accept a standard automotive blade-type fuse and is also configured such that it will removably fit within a standard automotive ferrule fuse socket.

According to a second aspect of this invention, there is provided a fuse adapter which includes means for insulating support, such as a rigid plastic insulating body, which has at least two end portions with an elongated slot in each end portion. The fuse adapter also has means, disposed within each slot, for electrically contacting and mechanically retaining a respective one of the flat blades of the blade-type fuse within the slot. In addition, the fuse adapter has a plurality of means for making electrical contact with a fuse clip for a glass ferrule fuse, where each such contacting means is fixed at a respective one of the end portions of the means for insulating support. Each contacting means is preferably formed as a metal end cap with a substantially cylindrical portion and an end face at one end of the cylindrical portion.

A third embodiment of the fuse adapter of the present invention is formed out of three separate pieces, namely an electrically insulating central body portion, which may be made of any suitable material such as plastic, ceramic or wood fiber material, and two electrically conductive end portions, which may be made of any suitable electrically conductive material, including but not limited to solid or stamped metal including metal alloys. In this embodiment of the adapter the electrically conductive end portions are permanently fastened or otherwise mechanically interlocked to the electrically insulating central body. The electrically conductive end portions act both as the end caps and as the blade contact members.

A fourth embodiment of the fuse adapter of the present invention is a single piece design made by injection molding of two dissimilar materials, one material being conductive in nature and the other being electrically insulating in nature. The end portions, which are made from the injectable electrically conductive material, may be formed substantially simultaneously with the central portion, which is made of injectable electrically insulating material.

A fifth embodiment of the present invention has a single slotted supported body made of nonconductive material. The surfaces on the end portions which need to be conductive may be coated, by plating or other suitable technique, with a conductive material such as chrome or other suitable metal.

Each of the foregoing embodiments of the fuse adapter of the present invention can be adapted to be used in the socket of the small size glass ferrule fuse. For example, insulating body may be made shorter, and the cylindrical portion of each end cap may be provided with a slotted opening therein so that a blade may be inserted through this slotted opening into the opening in the blade contact means or member thereunder.

In still another variation of the present invention, the fuse adapter may be provided with a means for controlling the rotation of the fuse adapter, such as a ridge or protrusion that runs longitudinally along the insulating support body. This protrusion interacts with one or both ferrule receiving fuse clips in the fuse socket to prevent the adapter from rotating about its axis while disposed within the ferrule socket. In yet another variation to the present invention, the slots in the insulating body and the corresponding portions of the fuse blade contacts may be tapered, i.e., flare outwardly, to facilitate the insertion of the blade-type fuse into the fuse adapter.

These and other features, advantages, and objects of the present invention will become more readily understood by studying the following detailed description of the preferred embodiments in conjunction with the attached Figures and subjoined claims.

BRIEF DESCRIPTION OF THE DRAWINGS

In the drawings, where like reference numerals are used to indicate identical components in the various Figures.

DETAILED DESCRIPTION OF THE PREFERRED EMBODIMENTS

Figure 1:
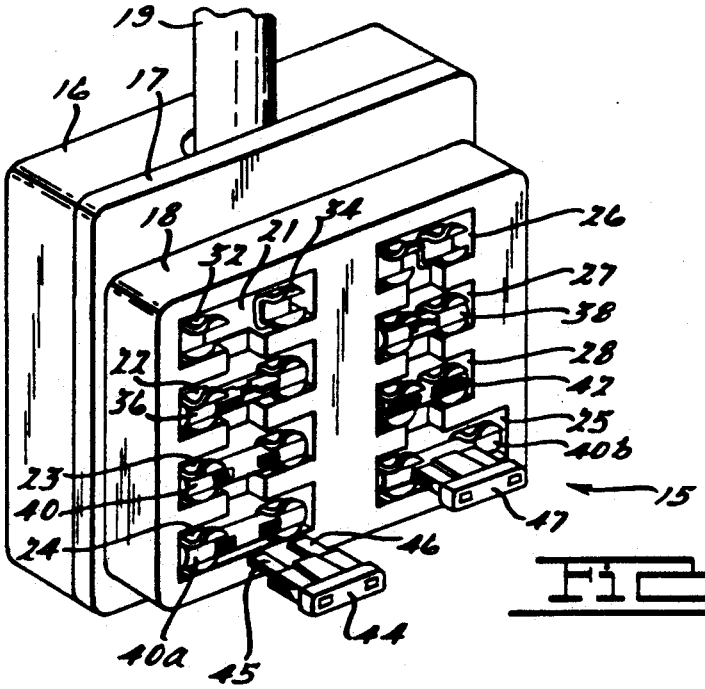
FIG. 1 is a perspective view of a multiple socket ferrule fuse box assembly illustrating two different sizes of empty ferrule fuse sockets, two sockets with ferrule fuses installed, and four sockets which include the fuse adapters of the present invention, including the bottom two sockets which respectively show a blade-type fuse about to be inserted into and inserted into the fuse adapters of the present invention.

Referring now to the drawings, FIG. 1 shows a ferrule fuse box assembly 15 which illustrates various fuse configurations and the use, interaction and differences between conventional glass ferrule fuses shown therein and the two embodiments of the automotive fuse adapters of the present invention which are also shown therein. Fuse box 15 includes a base 16, base access cover 17 and plastic housing 18. A wiring harness 19 is shown extending into the base 16. The housing 18 includes conventional sockets 21 through 25 which are of the standard large size mentioned earlier, and conventional sockets 26 through 28, which are of the standard small size also mentioned earlier. Each of the sockets includes a conventional pair of identical spring steel fuse retaining clips, such as clips 32 and 34 shown in socket 21. The base 16, cover 17, housing 18, and wiring harness 19 are all of well-known conventional design, and need not be further described.

Fuse sockets 21 and 26 are shown empty to better reveal the size and geometry of the conventional spring clips therein. A conventional glass ferrule fuse 36 is shown in the standard larger ferrule socket 22. Similarly, a short glass ferrule fuse 38 is shown in the standard small ferrule fuse socket 27.

A first embodiment of the present invention, namely, automotive blade-to-ferrule fuse adapter 40, is shown engaged in ferrule socket 23. This embodiment is the longer version of the fuse adapter of the present invention. The fuse adapters 40*a* and 40*b* shown in sockets 24 and 25 respectively are identical in construction to fuse adapter 40. A second embodiment of the present invention, namely, automotive blade-to-ferrule fuse adapter 42, is shown installed in ferrule socket 28. A standard blade-type automotive fuse 44, which includes flat blades 45 and 46, is shown ready for insertion into the automotive fuse adapter 40*a* installed in socket 24. Lastly in FIG. 1, at reference numeral 46 a large blade-type automotive fuse 47 is shown inserted into fuse adapter 40*b*, which in turn is installed in the ferrule fuse socket 25.

Figure 2:
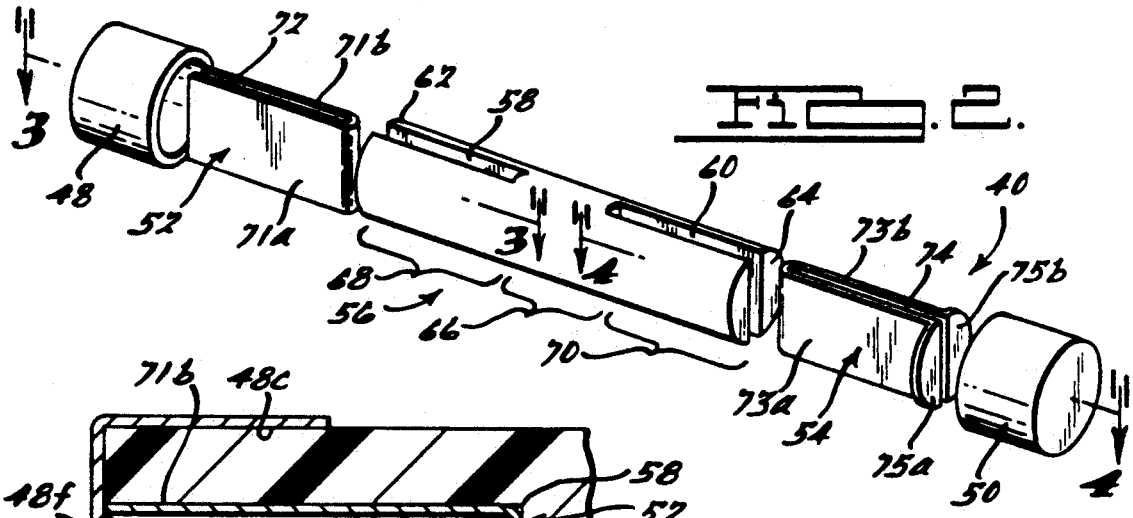
FIG. 2 is an exploded perspective view of a fuse adapter according to the present invention.

FIG. 2 is an exploded view illustrating the large size automotive fuse adapter 40 ready for assembly. The fuse adapter 40 includes identical end caps 48 and 50, fuse blade contact members 52 and 54, and an elongated rigid electrically insulating body 56. The body 56 is preferably about 1.1 inches long, and may be made of any suitably rigid insulating material including plastic, ceramic, or wood fiber materials. End caps 48 and 50 are preferably of the type used on glass ferrule fuses and are designed to fit within a standard ferrule fuse clip (such as clips 32 or 34 shown in FIG. 1) and to make electrical contact with blade contact members 52 and 54 respectively. Blade contact members 52 and 54 are preferably each made from elongated flat sheet of metal formed into the folded configuration shown in FIG. 2, so that each such member has an elongated U-shape. The insulating body 56 is generally cylindrical and includes two axially arranged elongated slots 58 and 60 which extend to the end faces 62 and 64 respectively. These slots are coplanar with respect to one other and sized so as to snugly receive the contact members 52 and 54 therein. Thus, the body 56 consists of a solid central portion of 66 and two slotted end portions 68 and 70. As can be seen in FIG. 2, the slots 58 and 60 are intermediate the end faces 62 and 64 and are coplanar with respect to one another.

In FIG. 2, two different types of blade contact members are shown. The blade contact member 52 includes two flat sidewalls 71*a* and 71*b* which terminate at open end 72. Similarly, blade contact member 54 includes flat sidewalls members 73*a* and 73*b* which terminate at open end 74. However, the open end portions of wall 73*a* and 73*b* each respectively include hemispherical flanges 75*a* and 75*b* formed at right angles to their respective wall portions 73*a* and 73*b*.

Figure 3:
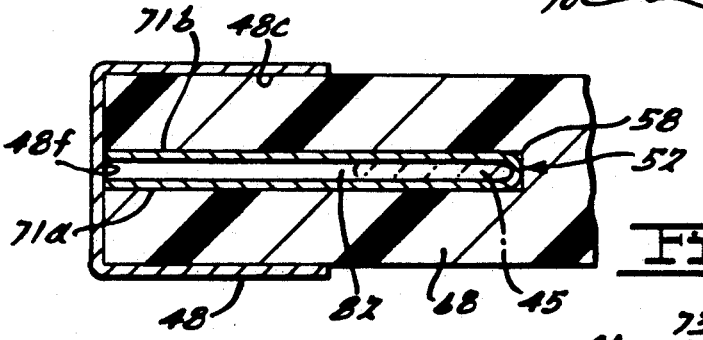
FIG. 3 is a fragmentary sectional view of the adapter in FIG. 2 taken along the line 3—3 of FIG. 2.

FIG. 3 is a cross-sectional view of the left end of FIG. 2 fuse adapter in its assembled state. The blade contact member 52 is shown disposed in slot 58 and the end cap 48 is shown snugly fitted over the outer half of end portion 68. Electrically contact between the cap 48 and member 52 is made by the ends of sidewalls 71*a* and 71*b* of contact member 52 butting up against face 48*f* of end cap 48 and by the upper and lower edges of sidewalls 71*a* and 71*b* of the contact member 52 bearing against the interior cylindrical surface 48*c* of end cap 48. The left blade 45 of automotive blade fuse 44 is shown in phantom located within the interior opening 82 of contact member 52. The width of this opening 82 is controlled by selecting the width of slot 58 and the thickness of the metal sheet for sidewalls 71 used to formed contact member 52, so as to form a snug frictional fit with good electrical contact between the blade 46 and contact member 52.

Figure 4:
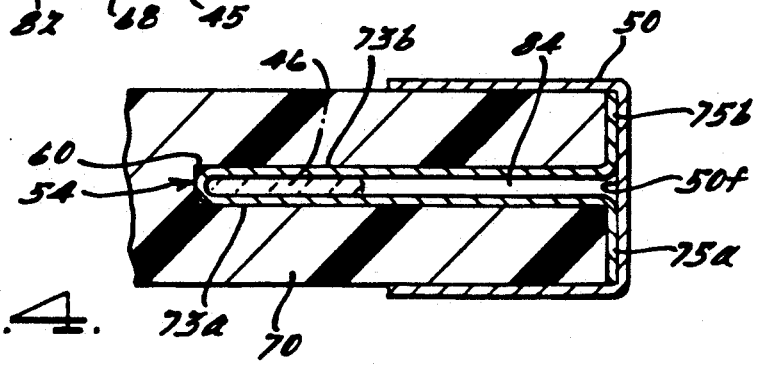
FIG. 4 is a fragmentary sectional view of the adapter in FIG. 2 taken along the line 4—4 of FIG. 2.

FIG. 4 is a fragmentary sectional view of right side assembled fuse adapter 40 taken along line 4—4 in FIG. 2. It shows that the hemispherical flanges 75*a* and 75*b* are pinned between slotted end face 64 and the circular interior face 50*f* of end cap 50. It should be apparent to those skilled in the art that this change helps provide for better mechanical rigidity to resist transverse forces experienced when right blade 46 of blade fuse 45 is inserted or withdrawn from the elongated opening 84 in contact member 54. Flanges 75*a* and 75*b* also assure extensive electrical contact between contact member 54 and end cap 50.

Figure 5:
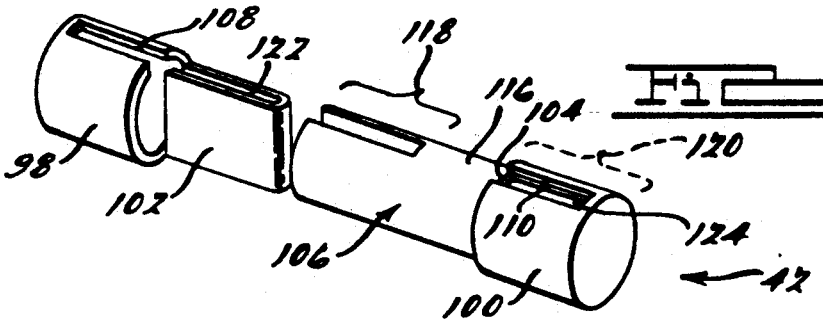
FIG. 5 is a perspective view of another shorter embodiment of a fuse adapter of the present invention, which has slotted end caps and is shown partially assembled.

FIG. 5 is a prospective view of the shorter fuse adapter 42 of the present invention shown in a partial assembled state. As shown at socket 28 of FIG. 1, this embodiment of the present invention is designed to permit a standard blade-type automotive fuse to be used in a standard small size ferrule fuse socket. The fuse adapter 42 includes identical slotted electrically conductive end caps 98 and 100, metallic blade contact members 102 and 104 and elongated, electrically insulating body 106. The overall length of this body 106 is approximately 0.7 inches long. The end caps 98 and 100 respectively include slotted openings 108 and 110. The body 106 includes a central body portion 116 and slotted end portions 118 and 120. When the fuse adapter 42 is fully assembled, the end caps 98 and 100 respectively substantially cover the end portions 118 and 120 of insulating body 106. The slots 108 and 110 in the end caps 98 and 100 are thus provided to permit access to the openings 122 and 124 respectively defined by the interior surfaces of the sidewalls of contact members 102 and 104. Thus, the flat blades of a standard size blade-type fuse, such as blades 45 and 46 of blade fuse 44, can be snugly slidably received in the openings 122 and 124 of contact members 102 and 104. In fuse adapter 42, like fuse adapter 40, the end caps are in good electrical contact in several places with their respective contact members. In both fuse adapters 42 and 44, the contact members and end caps remain electrically isolated from one another by virtue of the spacing provided by electrically insulated central portions 66 and 116 respectively. Also, in both embodiments, the end caps are preferably frictional fit onto the corresponding portions of the support of insulating body thereunder. If necessary or desirable, these end caps may be swaged, rolled or glued with epoxy to form a permanent mechanical joint between each end caps of the insulating body.

Figure 6:
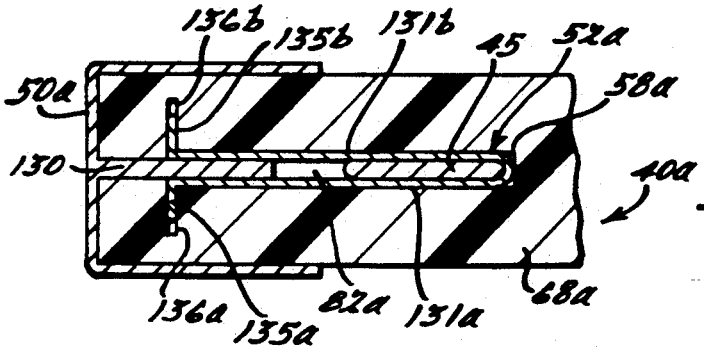
FIG. 6 is a fragmentary sectional view taken along the line 6—6 of FIG. 5 showing an alternative embodiment for the slot, contact member and end cap engagement.

FIG. 6 shows, in a fragmentary sectional view of a left end of fuse adapter 40*a* of the present invention, another configuration for interlocking a blade contact member with an end cap. FIG. 6 is thus similar in all respects to FIG. 3, but since it represents variation thereof, the suffix "a" has been added to each of the reference numerals. In FIG. 6, the end cap 50*a* has an internal wall portion 130 which is disposed in the opening 82*a* as shown. The contact member 52*a* has elongated flat wall portions 131*a* and 131*b*, with flanges 135*a* and 135*b* extending outwardly at right angles from the ends thereof into corresponding grooves 136*a* and 136*b* of body end portions 68*a*. As illustrated in FIG. 6, the central divider wall portion 130 of end cap 50*a* thus helps keep contact member 52*a* locked in place since it holds the flanges 136*a* and 136*b* in place within their respective grooves. The central wall portion 130 also makes good electrical contact with the wall portions 131*a* and 131*b* of contact member 52*a*. There is still room within opening 82*a* for the flat blade 45 of the standard automotive blade fuse 44 to snugly engage contact member 52*a* as shown.

Figure 7:
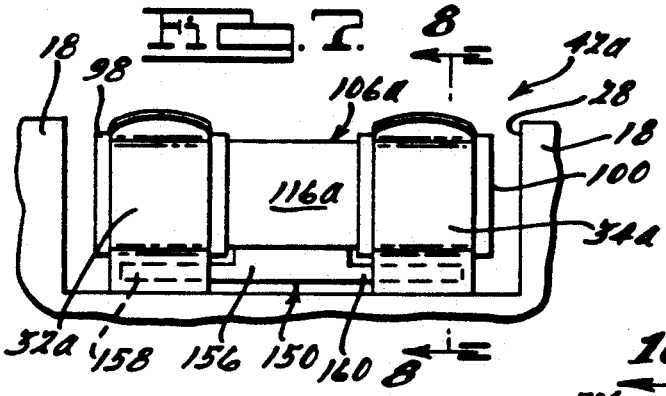
FIG. 7 is an enlarged side view of the fuse adapter in FIG. 5 disposed within a ferrule fuse socket, which illustrates an anti-rotation device of the fuse adapter.
Figure 8:
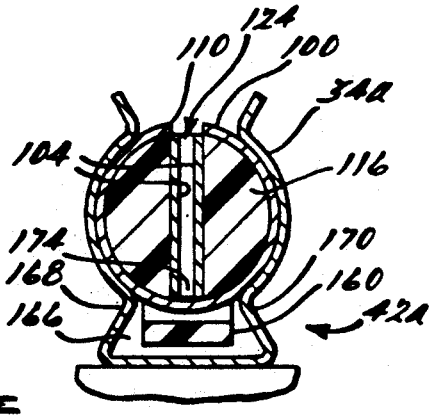
FIG. 8 is a sectional view taken along the line 8—8 of FIG. 7.

FIG. 7 is a side elevational view of another fuse adapter 42*a* of the present invention shown retained by spring clips, such as clips found 32*a* and 34*a* located in standard small size socket 28 of housing 18. Like fuse adapter 42 described and shown with respect to FIG. 5, fuse adapter 42*a* includes end caps 98 and 100, blade contact members 102 and 104 and an elongated, electrically insulating body 106*a* provided with elongated slots just like body 106. In fact, body 106*a* is identical to body 106 in all respects except for the anti-rotation device 150 extending downwardly therefrom. The anti-rotation device 150 may be integrally formed with, at the same time and from the same material as electrically insulated body 106*a*. The device 150 includes a central section 156 connected to the central body portion 116*a* of body 106*a*, and two elongated interlock members or protrusions 158 and 160 which extend into the bottom openings of the spring clips 21*a* and 34*a* as illustrated in FIGS. 7 and 8. FIG. 8 is a cross-sectional view taken along the line 8—8 of FIG. 7 showing how the interlock member 160 extends into the lower opening 166 formed by the bottom portions of legs 168 and 170 of spring clip 34*a*. FIG. 8 also shows that the blade contact member 104 disposed within the slots 110 of the body 116*a*. FIG. 8 also shows how the contact member 104 is in good electrical contact with the end cap 100 adjacent the bottom 174 of opening 124. The left-hand interlock member 162 is a mirror image of right-hand interlock member 164. Those skilled in the art will appreciate that interlocks 162 and 164 prevent the fuse adapter 142 from being rotated more than a few degrees about the longitudinal axes of body 106*a* since the interlock members 162 and 164 will contact the legs of the spring clips 32*a* and 34*a*. Thus the fuse adapter 42*a* will always remain positioned in the spring clips so that the slots 108 and 110 remain properly oriented as shown in FIG. 8 so that a blade fuse can be easily installed.

Figure 9:
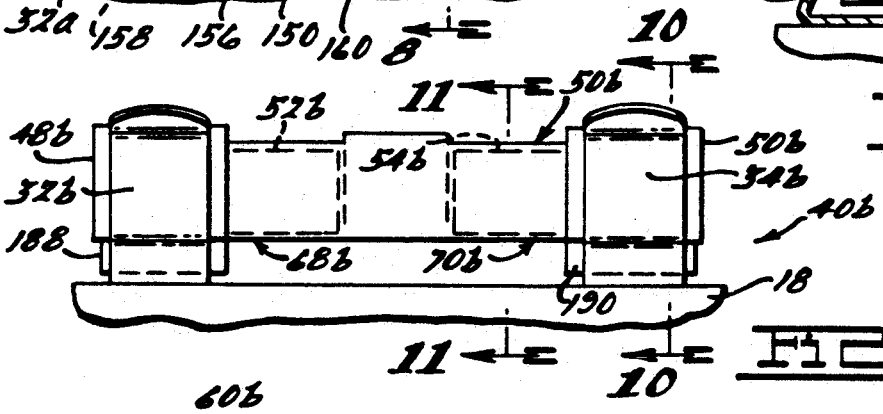
FIG. 9 is side view of a fuse adapter of the type shown in FIG. 1 disposed within a ferrule socket, and showing the anti-rotation ridges, as well as the silhouette of the tapered slots.

FIG. 9 shows yet another embodiment of the present invention, namely fuse adapter 40*b*. This fuse adapter 40*b* is identical in all respects to fuse adapter 40 shown in FIG. 2, except for the differences which will now be described. Fuse adapter 40*b* is retained by spring-loaded clips 32*b* and 34*b* and includes identical bottom-slotted end caps 48*b* and 50*b*, blade contact members 52*b* and 54*b* and elongated electrically insulating body 56*b*. The distinguishing features of the end caps, blade contact members and insulating body of fuse adapter 40*b* will now be explained by reference to FIGS. 9, 10 and 11.

Figure 10:
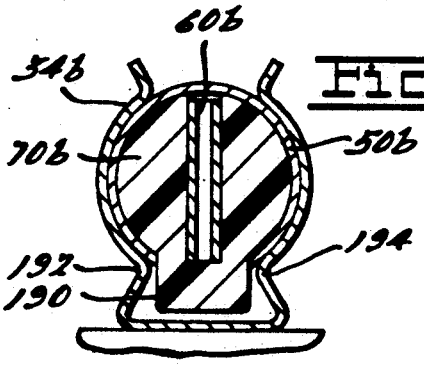
FIG. 10 is a sectional view taken along the line 10—10 of FIG. 9.

As best seen in FIG. 9, the outer halves of body end portions 68*b* and 70*b* respectively include ridges or protrusions 188 and 190 which extend downwardly from the generally cylindrical main parts of end portions 68*b* and 70*b*. FIG. 10 is a cross sectional view of the fuse adapter 40*b* taken along line 10—10 of FIG. 9. As shown best in FIG. 10, the rotational movement of fuse adapter 40 about its central longitudinal axis is thus prevented since the protrusion or ridge member 190 will contact the legs of spring retainer clip 34*b* in the vicinity of locations 192 and 194. Protrusion 188 interacts in a similar matter with the legs of spring clip 32*b*. Thus, rotation of the fuse adapter 40*b* is prevented.

Figure 11:
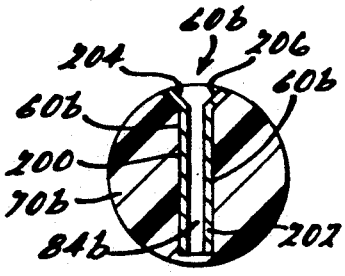
FIG. 11 is a sectional view taken along the line 11—11 of FIG. 9.

FIG. 11 is a cross sectional view of the end portions 70*b* of insulating body 56*b* taken along line 11—11 in FIG. 10. In FIG. 11, the blade contact member 54*b* is shown to have straight flat sidewall portions 200 and 202 which have top portions 204 and 206 respectively which taper outwardly. This in turn provides a flared opening 208 which leads to main portion of the opening 84*b* defined by the interior walls of blade contact member 54*b*. Slot 60*b* is correspondingly tapered in the vicinity of opening 208 to accommodate the flaring out of the contact member 54*b* at locations 204 and 206. This flared opening thus makes it somewhat easier to insert a blade-type automotive fuse into the fuse adapter 40*b*. Further, when the material out of which the end portions are made is at least a little bit flexible, the effective width of the slot may be made slightly smaller than the width of the blade to be inserted therein, so that the blade will be snugly held by the spring-like compressive reaction force produced the slight spreading apart of the two segments of the end portion on either side of the elongated slot.

Figure 12:
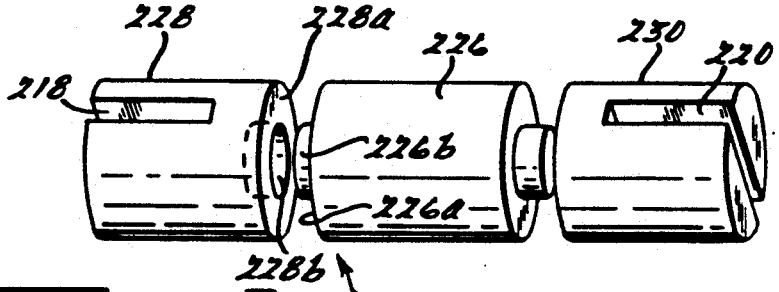
FIG. 12 is an exploded perspective view of a third embodiment of a fuse adapter of the present invention which has two electrically conductive end portions and an electrically insulating center body portion.
Figure 13:
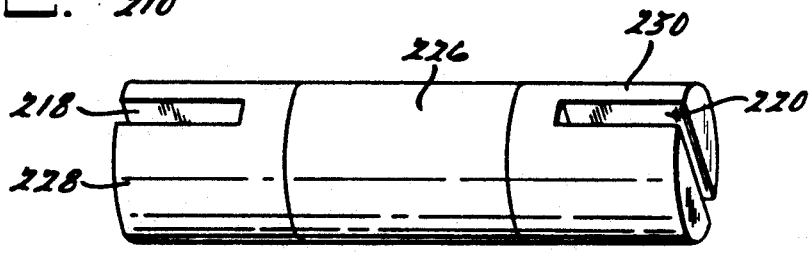
FIG. 13 is a perspective view of the FIG. 12 embodiment shown in an assembled state.

FIGS. 12 and 13 show a third embodiment of the present invention, namely fuse adapter 210, which generally has the same overall exterior shape as the body 56 of the fuse adapter 40 shown in FIG. 2. However, the fuse adapter 210 is formed out of three separate pieces, namely an electrical insulating central body portion 226 and two electrically conductive end portions 228 and 230. The central body 226 is made out of any suitable electrically insulating material, such as conventional plastic, ceramic or wood fiber material, while the two end portions 228 and 230 are made out of any suitable electrical conductive material, including but not limited to solid or hollow (i.e., stamped or otherwise formed) metal or electrically conductive plastic material. The two end portions 228 and 230 have slots 218 and 220 that are similar to the slotted end portions 68 and 70 of body 56 illustrated in FIG. 2. Those in the art will appreciate that the end portions 228 and 230 may be identical in shape.

The conductive end portions 228 and 230 may be permanently fastened to the insulating central body 226 through mechanical interlocking or by the use of adhesive, epoxy or equivalent bonding agents. The inside faces, such as face 228*a*, of these end portions are designed to be mechanical interconnected to the end faces of the central portion 226, such as end face 226*a*. One suitable form of mechanical interconnection is illustrated by the complementary male and female portions shown in FIG. 12, such as the projection or plug 226*b*, which is designed to be press fit in the recess or socket 228*b* in the conductive end portion 228. Alternatively, the projections may be threaded or ridged so as to screw or snap into their respective complementary recesses. When assembled, the fuse adapter 210 has an appearance as shown in FIG. 13.

Figure 15:
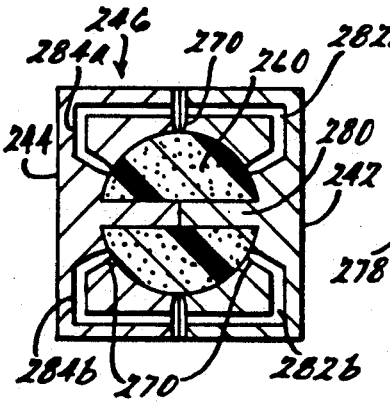
FIG. 15 is a sectional view taken along the line 15—15 of the fuse adapter and mold of FIG. 14.
Figure 14:
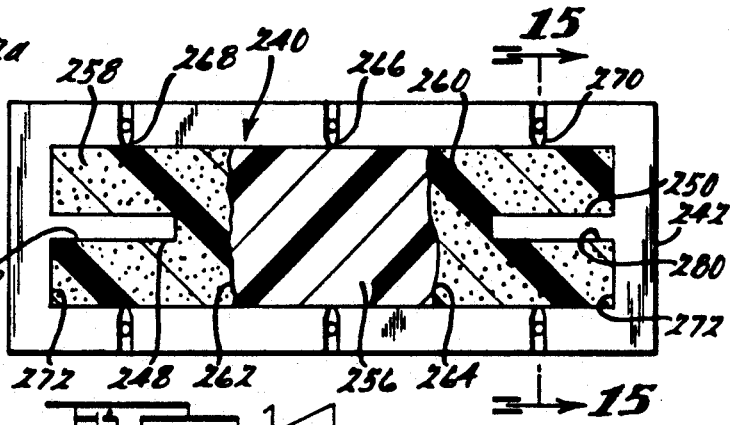
FIG. 14 is a cross-sectional view of a fourth embodiment of the fuse adapter of the present invention within one-half of an plastic injection mold that may be used to produce same.

FIGS. 14 and 15 shows two cross-sections of a fourth embodiment of the present invention, which is one-piece molded fuse adapter 240. FIG. 14 shows one-half of the fuse adapter 240 positioned in one of two halves 242 and 244 of a closable metal mold 246 that may used to form the adapter. The fuse adapter 240 is preferably made from two different types of plastic materials, the first of which is electrically insulative and is used to form the central body portion 256, and the other of which is electrically conductive, and is used to form the two slotted end portions 258 and 260. Most plastics naturally are electrical insulators at the normal operating temperatures and voltage levels experienced by glass ferrule fuses and/or blade-type fuses. It is this kind of material that the central body portion 256 is made of. But, a number of different types of electrically conductive moldable plastic materials have been known for years, and are available from various plastics companies, such as E. I. dupont de Nemours & Co., Inc. of Wilmington, Del. The term electrically conductive plastic material as used herein includes electrically conductive polymers, as well as plastics or other binder materials to which a conductive filler such as carbon black powders, metal particulates or tiny metal fibers have been added to render the material electrically conductive. The end portions 258 and 260 are made of this kind of electrically conductive material. End portions 258 and 260 are provided with slots 248 and 250 that are designed to make mechanical and electrical contact with the blade portions of the blade-type fuse. Wavy lines 262 and 264 represent the boundaries between the central body portion 256 and end portions 258 and 260. As will further explained, the central portion 256 is cohesively bonded to the end portions 258 and 260 at the time of molding.

FIGS. 14 and 15 together illustrate one way to form the fourth embodiment of the present invention using plastic injection molding techniques. As may be seen in FIG. 14, each of the mold portions 242 and 244 of the injection mold 246 is provided with three sets 266, 268 and 270 of sprue holes which respectively are used to provide molten plastic material to portions 256, 258 and 260 of the generally cylindrical cavity 272 of the mold 246. The shape of cavity 272 is defined by the desired outer surface configuration of the fuse adapter 240, which will when formed have an overall exterior shape just like the fuse adapter 210 shown in FIG. 13. The projections 278 and 280 of the mold 246 serve to define the slots 248 and 250 present in fuse adapter 240 of FIG. 14.

FIG. 15 is a cross-sectional view taken along the line 15—15 of the injection mold 246 shown in FIG. 14 showing the two mold halves 242 and 244 of the mold. FIG. 15 also shows one possible configuration for passageways 282*a* and 282*b* and 284*a* and 284*b* leading to the six sprue holes 220 distributed equiangularly about the circumference of the cavity 272. The sprue holes for the other two portions of the fuse adapter may be similarly arranged equiangularly about the circumference of the mold cavity 272.

At the start of the injection mold process, the cavity 272 is initially empty, and the mold 246 is closed as shown in FIG. 15. As a first step of the injection molding cycle, a known quantity of molten plastic of the electrically insulating type is shot (i.e., forced) through the center sprue holes 266, thereby filling up the mold cavity 272 in the area of the central body portion 256 of the fuse adapter 240. A few fractions of a second later, electrically conductive molten plastic is then simultaneously forced through the two end sets 268 and 270 of sprue holes until the cavity 272 is completely filled with plastic material. During the second step, the electrically insulative plastic material is forced into intimate contact with the electrically conductive plastic material of the central body portion along the boundaries 262 and 264, so that the material is hermetically binds together as it cools. Next, the mold 246 is allowed to sit for a few to several seconds to allow the molten plastic inside the cavity to cool sufficiently to solidify. Then, after sufficient cooling, the plastic injection mold is opened, and the completed fuse adapter 240 just formed is ejected from the mold cavity 272 by any suitable means.

The foregoing injection molding cycle may be repeated to form additional parts. Those skilled in the art will also appreciate multiple fuse adapters may be simultaneously formed simply by providing multiple cavities like cavity 272 in the same mold assembly. The general shape of the injection mold 240 maybe rectangular, as shown, or any other desired shape to allow it to be fastened in conventional manner to plastic injection molding machines. Such machines are conventionally equipped with electric mold heaters, molten plastic feed augers or pumps, plastic shut-off valves and/or sprue gates to deliver the plastic in a proper volumes and at the desired times to the passageways in a mold.

Figure 16:
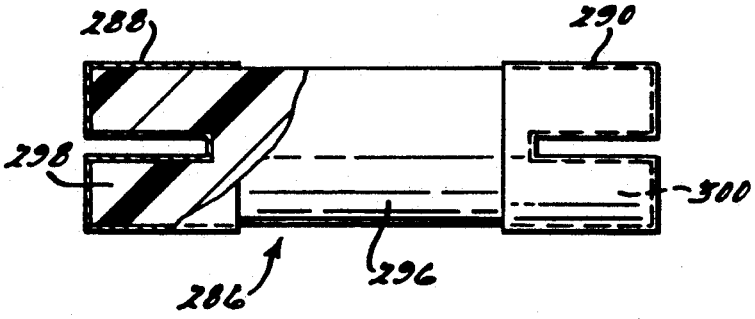
FIG. 16 is a plan view of a fifth embodiment of the present invention having a partial cross-section to illustrate the manner in which the conductive endcaps are formed.

FIG. 16 shows a fifth embodiment of the present invention in plan view with the left end thereof shown in partial cross-section. The one-piece body 286 has the same general shape as the body 56 of the fuse adapter shown in FIG. 2, and is preferably formed out of an electrically insulating material such as thermoplastic, thermosetting or ceramic material. The conductive end cover portions 288 and 290 are made of a conductive material such as but not limited to metal. The conductive end cover portions may be a cap formed out of thin metal stock stamped to have the desired configuration to allow them to slip onto the end portions of one-piece body portion with a snug fit. Preferably, though, the end cover portions are formed from a thin deposited layer of chrome, copper alloy or a similar electrically conductive material that can be plated upon or otherwise deposited in any suitable manner upon the body 286. If the plating method of formation is utilized, the central portion 296 of the body 286 may be masked off, so as to not accept the conductive metal being deposited on the end portions 298 and 300. Alternatively, if the central portion 296 is coated with a conductive material, it can be removed by selectively etching the conductive material away from just the central body portion of the fuse adapter 286.

I contemplate that consumers interested in my automotive blade-to-ferrule fuse adapter will also be in need of the blade-type fuses. Accordingly, both of the most common sizes of automotive blade-to-ferrule fuse adapters may be provided as part of fuse socket conversion kit. The fuse kit includes a blade-type fuse in combination with one of the aforementioned fuse adapters. In addition, several such fuse kits may be offered together as a package designed to convert all glass ferrule fuses in a given automotive vehicle to automotive blade fuses by providing the correct number and sizes of fuse adapters and fuses for the right ampacities for the vehicle in question.

While the foregoing embodiments of the present invention are well-suited to achieve the objects stated above, those skilled in the art should realize that such embodiments are subject to modification, alteration and change without departing from the scope of the present invention. For example, rather than having two protrusions or interlock members on each anti-rotation device provided on a fuse adapter, a single protrusion or interlock member may be used as the anti-rotation device.

As another example, the flared opening to the elongated slot for the blade of the fuse illustrated in FIG. 11 can be utilized with every embodiment of the invention. Other variations will no doubt occur to those skilled in the art upon study of the description and Figures herein. Accordingly, it is to be understood that the present invention is not limited to the specific embodiments described and/or illustrated herein, but should be deemed to extend to the subject matter defined by the appended claims, including all fair equivalents thereof.

I claim:

1. An automotive fuse adapter for allowing a blade-type automotive fuse to be used in a glass ferrule-type automotive fuse socket, the fuse adapter comprising:

an elongated substantially rigid body having an two end portions electrically insulated from one another, with each such end portion having an elongated slot formed therein;

two blade contact means, each disposed within a respective one of the slots in the body and made of electrically conductive material formed in a preselected shape, and each for receiving therein and making electrical contact with one blade of a blade-type automotive fuse; and two end cap means, each being fixed about a respective end portion of the body and in electrical contact with a respective one of the blade contact means, for making electrical contact with and for being received within an electrically conductive retaining clip used within a standard size socket for an automotive glass ferrule fuse.

2. The fuse adapter of claim 1, wherein the body is substantially cylindrical in overall configuration.

3. The fuse adapter of claim 1, wherein the slots are arranged along the longitudinal axis of the body and are coplanar with respect to each other.

4. The fuse adapter of claim 1, wherein the rigid body is formed of electrical insulating material which includes plastic.

5. The fuse adapter of claim 1, wherein the rigid body is formed of electrical insulating material selected from the group of insulating electrical insulating material including ceramic material and wood fiber material.

6. The fuse adapter of claim 1, wherein each of the blade contact means include a thin layer of electrically conductive material disposed within one of the slots within the body, and the blade contact means is arranged so that an opening is provided to snugly receive one of the blades of the blade-type automotive fuse.

7. The fuse adapter of claim 1, wherein the blade contact means are members each separately formed from a thin metal sheet stock and each have an elongated U-shape section and an opening within the such U-shape to snugly accept one of the blades of a standard automotive blade-type fuse.

8. The fuse adapter of claim 1, wherein:

each end portion of the body is substantially cylindrical in configuration and includes a slotted end face of substantially circular configuration, each of the end cap means includes an end cap formed of thin metal which has a circular end cap portion and cylindrical side wall portion closed at one end thereof by the circular end cap portion, and each such cap covers the end face of one of the end portions of the body, and at least part of the end portion.

9. The fuse adapter of claim 1 for use in a small size ferrule fuse socket, wherein:

each end portion of the body is substantially cylindrical in configuration and is bisected along its longitudinal axis by one of the slots, each of the end cap means includes an end cap formed of thin conductive material provided with a slotted opening and arranged such that the slotted opening in the end cap is in line with the slot provided in the end portion associated with the end cap.

10. The fuse adapter of claim 1, further comprising means for controlling rotation of the fuse adapter about its longitudinal axis when placed in a standard automotive glass ferrule fuse socket having two U-shaped retaining clips at opposite ends of the socket.

11. The fuse adapter of claim 10, wherein the means for controlling the rotation is a ridge running longitudinally along at least one end portion of the body.

12. The fuse adapter of claim 1, wherein:

the contact members each generally have an elongated U-shaped cross-section with an elongated opening therein, and the slots in the body and corresponding portions of the contact members flare outwardly from one another, thereby facilitating insertion of the blades of an automotive blade-type fuse into the openings of the contact members.

13. A fuse adapter for receiving a standard automotive blade-type fuse having a pair of coplanar flat blades, the fuse adapter comprising:

means for insulating support having at least two end portions and at least two slots formed in the respective end portions;

means, disposed within each slot, for electrically contacting and mechanically retaining therein a respective one of the flat blades of the blade-type fuse; and a plurality of means for making electrical contact with a fuse clip for a glass ferrule fuse, each such means for making electrical contact being fixed over a respective one of the end portion of the means for insulating support, and being in electrical contact with a respective one of the means for electrically contacting one of the flat blades, the means for making electrical contact adapted to be received within an electrically conductive retaining clip used within a standard size socket for an automotive glass ferrule fuse.

14. The fuse adapter of claim 13, wherein:

the means for insulating support is generally cylindrical in overall configuration, and each of the means for making electrical contact with a fuse clip includes at least a generally cylindrical band of electrically conductive metal which fits over a respective end portion of the means for insulating support.

15. The fuse adapter of claim 13, wherein the slots are arranged longitudinally along the means for insulating support and coplanar with respect to one another.

16. The fuse adapter of claim 13, further comprising means for preventing rotation of the fuse adapter about its longitudinal axis when the fuse adapter is placed within retaining clips of a standard ferrule-type fuse socket.

17. The fuse adapter of claim 13, wherein the means for insulating support includes a generally cylindrical elongated insulating body, and means for preventing rotation of the cylindrical member about its longitudinal axis when the fuse adapter is placed within retaining clips of a standard glass ferrule-type fuse socket, the means for preventing rotation being provided with at least one member rigidly connected to and which extending beyond the cylindrical body and portioned to fit within and be contained by at least one retaining clip, whereby rotation of the fuse adapter in the socket is prevented.

18. The fuse adapter of claim 13, wherein the slots are tapered to assist ease of insertion of blades of an automotive blade-type fuse therein.

19. A fuse kit for a ferrule-type fuse box including at least one socket for a glass ferrule-type fuse, the socket including a pair of spring loaded retaining clips, the fuse adapter kit comprising:

at least one automotive blade-type fuse; and a fuse adapter configured to be removably disposed in the ferrule-type fuse box, the fuse adapter having means for insulating support having at least two end portions and at least two slots in the respective end portions, a plurality of blade fuse contact members, one such member being disposed within each slot, and a plurality of electrical contact band members, each end contact band member being attached over a respective one of the end portions, each end contact band member being in electrical contact with a respective one of the blade fuse contact members, the blade fuse contact member being configured to removably receive and mechanically retain therein a blade of the automotive blade-type fuse, each contact band member adapted to be received within an electrically conductive retaining clip used within a standard size socket for an automotive glass ferrule fuse.

20. The fuse kit in claim 19, wherein the fuse adapter further includes means for controlling rotation, arranged longitudinally along the means for insulating support, whereby rotation of the fuse adapter is prevented when the fuse adapter is placed in the socket including the spring loaded retaining clips.

* * * * *